US008292993B2

(12) United States Patent
Inagawa et al.

(10) Patent No.: US 8,292,993 B2
(45) Date of Patent: Oct. 23, 2012

(54) ELECTROLESS NICKEL PLATING BATH AND METHOD FOR ELECTROLESS NICKEL PLATING

(75) Inventors: Hiromu Inagawa, Osaka (JP); Daisuke Hashimoto, Osaka (JP); Shinji Ishimaru, Osaka (JP); Masayuki Kiso, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 394 days.

(21) Appl. No.: 12/627,624

(22) Filed: Nov. 30, 2009

(65) Prior Publication Data

US 2010/0136244 A1 Jun. 3, 2010

(30) Foreign Application Priority Data

Dec. 3, 2008 (JP) ..... 2008-308536

(51) Int. Cl.
*C23C 18/32* (2006.01)
*C23C 18/36* (2006.01)

(52) U.S. Cl. ..... 106/1.22; 106/1.27

(58) Field of Classification Search ..... 106/1.22, 106/1.27
See application file for complete search history.

(56) References Cited

U.S. PATENT DOCUMENTS

| | | | | | |
|---|---|---|---|---|---|
| 3,265,511 | A | * | 8/1966 | Sallo | 106/1.22 |
| 3,702,263 | A | * | 11/1972 | Hall et al. | 427/132 |
| 3,971,861 | A | * | 7/1976 | de Waltoff | 106/1.22 |
| 4,072,781 | A | * | 2/1978 | Shirahata et al. | 428/336 |
| 4,128,691 | A | * | 12/1978 | Shirahata et al. | 428/336 |
| 4,250,225 | A | * | 2/1981 | Shirahata et al. | 428/336 |
| 4,511,614 | A | * | 4/1985 | Greeson et al. | 428/141 |
| 4,804,410 | A | * | 2/1989 | Haga et al. | 106/1.23 |
| 4,830,889 | A | | 5/1989 | Henry et al. | |
| 5,232,744 | A | | 8/1993 | Nakamura et al. | |
| 5,753,304 | A | | 5/1998 | Tung | |
| 5,897,692 | A | | 4/1999 | Kotsuka et al. | |
| 5,910,340 | A | * | 6/1999 | Uchida et al. | 106/1.22 |
| 6,146,702 | A | * | 11/2000 | Zitko | 427/376.6 |

FOREIGN PATENT DOCUMENTS

| | | |
|---|---|---|
| EP | 1 020 542 A2 | 7/2000 |
| JP | 04-157169 | 5/1992 |

* cited by examiner

*Primary Examiner* — Helene Klemanski
(74) *Attorney, Agent, or Firm* — Haverstock & Owens LLP

(57) ABSTRACT

Disclosed is an electroless nickel plating bath not containing harmful metal species. In the electroless nickel plating bath, there are contained at least an iron ion source and an iodide ion source. With the use of the electroless nickel plating bath containing at least the iron ion source and the iodide ion source, it is possible to suppress decomposition of the plating bath without using harmful metal species to stabilize the plating bath.

7 Claims, No Drawings

ELECTROLESS NICKEL PLATING BATH AND METHOD FOR ELECTROLESS NICKEL PLATING

BACKGROUND OF THE INVENTION

1. Field of the Invention

This invention relates to an electroless nickel plating bath not employing harmful metal species, a stabilizer for the electroless nickel plating bath, a method for electroless nickel plating, and to a method for managing the electroless nickel plating bath.

2. Description of Related Art

The electroless nickel plating yields high film characteristics and a sufficiently uniform precipitation characteristic, and hence has been in extensive use. Among a variety of electroless nickel plating baths used for electroless nickel plating, there are known, for example, a plating bath that uses sodium hypophosphite, a phosphorus compound, as a reducing agent (a Ni—P bath), and a plating bath that uses dimethylamino borane (DMAB), a boron compound, as a reducing agent (a Ni—B bath). The electroless nickel plating bath is referred to below simply as a plating bath.

The electroless nickel plating suffers from problems such as a phenomenon of sudden abnormal precipitation ascribable to active hydrogen generated by oxidation of a reducing agent, that is, decomposition of a plating bath. To prevent such decomposition of the plating bath to enable the plating bath to be used for a prolonged period of time, a stabilizer is usually added to the plating bath. Harmful metal species, such as lead or bismuth, are known to be effective as the stabilizer for the electroless nickel plating (see Patent Publication 1, for example).

[Patent Publication 1] Japanese Laid-Open Patent Publication 2007-154223

DISCLOSURE OF THE INVENTION

Problem to be Solved by the Invention

However, harmful metals, such as lead or bismuth, are desirably not used for the sake of safety or in view of environmental regulations which are becoming tighter. In addition, if these metals are precipitated into a nickel film as a result of the reducing reaction, the metal concentration is lowered with progress of the processing for plating. If the metal concentration falls to a level not higher than a predetermined value, the plating bath is decomposed, as stated above.

The present invention intends to solve the above problem. It is thus an object of the present invention to provide an electroless nickel plating bath, a stabilizer for the electroless nickel plating bath, a method for electroless nickel plating, and a method for managing the electroless nickel plating bath, according to which the plating bath may be stabilized without using harmful metal species.

SUMMARY OF THE INVENTION

To solve the above problem, the electroless nickel plating bath contains at least an iron ion source and an iodide ion source.

A stabilizer for the electroless nickel plating bath according to an embodiment of the present invention at least comprises an iron ion source and an iodide ion source.

A method for electroless nickel plating according to an embodiment of the present invention comprises immersing an object for plating in an electroless nickel plating bath containing at least an iron ion source and an iodide ion source to deposit an electroless nickel plating film on a surface of the object for plating.

A method for managing an electroless nickel plating bath according to an embodiment of the present invention comprises adding at least an iron ion source or an iodide ion source to the electroless nickel plating bath to preserve the bath.

An electroless nickel plating bath for depositing an electroless nickel plating film on a surface of an iron-based object for plating, according to an embodiment of the present invention, contains at least an iodide ion source.

A method for electroless nickel plating according to an embodiment of the present invention comprises immersing an iron-based object for plating in an electroless nickel plating bath containing at least an iodide ion source to deposit an electroless nickel plating film on a surface of the iron-based object.

According to an embodiment of the present invention, in which an electroless nickel plating bath, at least containing an iron ion source and an iodide ion source, is used, the plating bath may be prevented from being decomposed without using harmful metal species, thereby stabilizing the plating bath.

DESCRIPTION OF THE PREFERRED EMBODIMENTS

The best mode for carrying out the present invention, referred to below as an embodiment of the present invention, will now be described in detail.

<Plating Bath>

In a plating bath according to the embodiment of the present invention, there are contained a water-soluble nickel salt, a reducing agent, a complexing agent, an iron ion source and an iodide ion source, for example.

Initially, the iron ion source is explained. As regards the iron ion source, there is no particular limitation provided that the iron ion source catalytically acts on the iodide ions. For example, ion sources of divalent or trivalent iron, that is, iron sulfate, iron chloride, iron sulfide, iron nitrate or iron oxide, may be used. These iron ion sources may be used either alone or as a mixture. The concentration of the iron ion sources is preferably on the order of 0.01 to 100 mg/L. With this range of the iron ion source concentration, it is possible to prevent formation of pits on the object for plating, that is, macroscopic holes in the surface of the plating film. It is more preferred that the concentration of the iron ion source is 0.1 to 10 mg/L. In this case, the macroscopic holes may be prevented more effectively from being formed in the surface of the plating film.

The iodide ion source will now be explained. As regards the iodide ion source, there is no particular limitation provided that the iodide ion source used will act moderately as an oxidizing agent on iron ions in the plating bath. For example, potassium iodide, iron iodide, nickel iodide, lithium iodide or sodium iodide, may be used. These iodide ion sources may be used either alone or as a mixture.

The iodide ions act moderately on the iron ions as an oxidizing agent, as set forth above, and hence may be optimally used in a broad range of the concentration. For example, the concentration of the iodide ion sources is preferably on the order of 10 to 4000 mg/L. With this range of concentration of the iodide ion source, the plating bath may be stabilized to prevent the rate of precipitation of the nickel plating film from being lowered. In particular, with the plating bath of the present embodiment, it is most preferred to set the concentration of the iodide ion source to 500 to 2000 mg/L. In this case, the state of the plating bath may be made more stable, with the result that the rate of precipitation of the nickel plating film may be prevented more effectively from being lowered.

The operation of the iron ion source and the iodide ion source in the plating bath according to the present embodiment will now be described in detail.

Active hydrogen, generated on oxidation of the reducing agent, is felt to be taking part in the decomposition of the plating bath, as set out above. To stabilize the plating bath, initially made up, it is necessary to prevent decomposition of the plating bath ascribable to active hydrogen generated. With the plating bath of the present embodiment, the reactions of the following formulas (1) to (3):

$$Fe^{2+} \rightarrow Fe^{3+} \quad (1)$$

$$Fe^{3+} + I^{-} \rightarrow I + Fe^{2+} \quad (2)$$

$$2H^{*} + I \rightarrow H_2 + I^{-} \quad (3)$$

are thought to occur as a result of the bath containing the iron ion source and the iodide ion source. Specifically, divalent iron ions ($Fe^{2+}$) from the iron ion source are oxidized with air to yield trivalent iron ions ($Fe^{3+}$), as shown in the formula (1). Next, iodide ions ($I^{-}$) from the iodide ion source react with trivalent iron ions to yield iodine (I) and divalent iron ions ($Fe^{2+}$), as shown in the formula (2). Then, iodine (I) and active hydrogen (H*) react with each other, as shown by the formula (3), to yield a hydrogen gas ($H^2$) and iodide ions ($I^{-}$).

Thus, with the plating bath of an embodiment of the present embodiment, in which there are contained the iron ion source and the iodide ion source, the cyclic reactions in accordance with the above formulas (1) to (3) take place. That is, the divalent iron ions ($Fe^{2+}$), yielded by the formula (2), are again turned into trivalent iron ions ($Fe^{3+}$) by the formula (1), and the iodide ions ($I^{-}$), generated by the formula (3), are again turned into iodine (I) in accordance with the formula (2). By the cyclic reactions of the above formulas (1) to (3), the quantity of active hydrogen (H*) in the plating solution may be reduced to prevent decomposition of the plating bath to stabilize it. That is, with the plating bath of the present embodiment, decomposition of the plating bath is suppressed without using harmful metals, in contradistinction from the conventional practice, thereby stabilizing the plating bath.

Moreover, with the present plating bath, in which there are contained the iron ion source and the iodine ion source, the film characteristics may be optimized. Specifically, when the harmful metals, such as lead or bismuth, are used as a stabilizer, these metals are precipitated into the nickel film. In the plating bath according to the present embodiment, there is no risk of precipitation of the harmful metals in the nickel film, thus assuring optimum film characteristics.

On the other hand, it is necessary to prevent decomposition of the plating bath, ascribable to generation of active hydrogen, during the processing for plating, as during the time other than the time for processing for plating. However, during the processing for plating, a hydrogen gas is yielded, with the result that the quantity of oxygen, dissolved in the plating bath, becomes smaller than that during the time other than the time for processing for plating. Hence, it becomes difficult to stabilize the plating bath. With the plating bath of the present embodiment, the oxidizing agent for reducing or eliminating active hydrogen, which may be yielded at the time of the processing for plating, is added during the processing for plating, thereby enabling the plating bath to be used in stability for a prolonged period of time.

There is no limitation to the oxidizing agent provided that it is an iodate ion source or a bromate ion source. The iodate ion source may be enumerated by, for example, potassium iodate, sodium iodate and ammonium iodate. The bromate ion source may be enumerated by, for example, potassium bromate, sodium bromate and ammonium bromate. With the plating bath of the present embodiment, it is more preferred to use the iodate ion source that is more potent as the oxidizing agent. These oxidizing agents may be used either singly or as a combination.

The oxidizing agent is consumed by being reduced by a reducing agent. Thus, if an excess quantity of the oxidizing agent is added to the plating solution, there are induced changes in the characteristics of the nickel plating film, such as changes in the rate of precipitation, during the processing for plating. Also, if too much oxidizing agent is added to the plating bath, the amount of consumption of the oxidizing agent is increased, thus presents an economical demerit. It is therefore desirable to add an amount of the oxidizing agent just necessary to keep the stabilized state of the plating bath. For example, the concentration of the oxidizing agent is preferably set to 0.1 to 100 mg/L. With the so set concentration, changes in the film characteristics during the processing for plating, such as the rate of precipitation of the nickel plating film, may be reduced. In addition, the amount of consumption of the oxidizing agent may be suppressed to a smaller quantity, while the plating bath may be maintained in stability. In particular, with the plating bath according to the present embodiment, it is more desirable to set the amount of consumption of the oxidizing agent to 0.2 to 10 mg/L, in which case it becomes possible to maintain the plating bath in a more stable state.

The water-soluble nickel salt, reducing agent and the complexing agent, used in the plating bath according to the present embodiment, will now be explained. As regards the water-soluble nickel salts, those which are soluble in the plating bath and which will yield an aqueous solution of a predetermined concentration may be used without any particular restrictions. The water-soluble nickel salts may be enumerated by, for example, inorganic water-soluble nickel salts, such as nickel sulfate, nickel chloride or nickel hypophosphite, and organic water-soluble nickel salts, such as nickel acetate or nickel malate. The water-soluble nickel salts may be used alone or as a mixture. The concentration of the water-soluble nickel salts is desirably on the order of 5 to 70 g/L. With this concentration, it is possible to prevent that the rate of precipitation of the nickel plating film is drastically retarded to lead to prolonged film-forming. It is moreover possible to prevent that the plating bath becomes highly viscid to deteriorate the fluidity of the plating bath to render the precipitation performance uneven, and that there are formed pits in the film deposited. With the plating bath of the embodiment, it is more preferred to set the concentration of the water-soluble nickel salt to the order of 20 to 50 g/L because it then becomes possible to prevent that the rate of precipitation of the nickel plating film is retarded or that there are formed pits in the film deposited.

The reducing agent may be any of a variety of reducing agents used in known types of the electroless nickel plating solutions. The reducing agents may be enumerated by, for example, hypophosphites and boron compounds. Examples of the hypophosphites include sodium hypophosphite (soda hypophosphite) and potassium hypophosphite. Examples of the boron compounds may include boron hydride compounds, such as sodium boron hydride or potassium boron hydride, and amine borane compounds, such as dimethyl amine borane or trimethyl amine borane.

Although the concentration of the reducing agent differs with the types of the reducing agents, it is preferably 20 to 50 g/L if sodium hypophosphite is used as the reducing agent. With this concentration of the reducing agent, it is possible to prevent that the reduction of nickel ions in the plating solution is retarded to cause time delay in film forming and that the plating bath is decomposed. With the plating bath of the present embodiment, it is more preferred that the concentration of sodium hypophosphite is 20 to 35 g/L. In this case, it is possible to effectively prevent that the film forming becomes excessively time-consuming and that the plating bath is decomposed.

If DMAB, a boron compound, is used as a reducing agent, it is desirable that the concentration of DMAB is on the order of 1 to 10 g/L. With this order of the concentration, it is possible to prevent that the film forming is excessively time-consuming and that the plating bath is decomposed. Also, if DMAB, a boron compound, is used as the reducing agent, it is more desirable that the concentration of DMAB is on the order of 3 to 5 g/L. In this case, it is possible to prevent that the film forming is excessively time-consuming and that the plating bath is decomposed.

The complexing agent is an ingredient effective to prevent precipitation of the nickel compound and to provide for a moderate rate of the reaction of nickel precipitation. A variety of complexing agents, used in known electroless nickel plating solutions, may be used. Specified examples of the complexing agents may include monocarboxylic acids, such as glycolic acid, lactic acid, gluconic acid or propionic acid, dicarboxylic acids, such as malic acid, succinic acid, tartaric acid, oxalic acid or adipic acid, aminocarboxylic acids, such as glycine or alanine, ethylene diamine derivatives, such as ethylenediamine tetraacetate, versenol (N-hydroxyethyl ethylenediamine-N,N',N'-triacetic acid) or quadrol (N,N,N',N'-tetrahydroxyethyl ethylene diamine), phosphnic acids, such as 1-hydroxyethane-1,1-diphosphonic acid, ethylene diamine tetramethylene phosphonic acid and water-soluble salts thereof. The complexing agents may be used either alone or in combination.

There is no particular restriction to the concentration of the complexing agents which differs with the sorts of the agents. However, it is usually selected to be on the order of 0.001 to 2 mol/L. With this range of the concentration of the complexing agent, it is possible to prevent that the plating bath is decomposed due to precipitation of nickel hydroxide or to an excessively high reaction rate of oxidation/reduction. With the concentration of the complexing agent in this range, it is also possible to prevent that the rate of precipitation of the nickel plating film is retarded or that the performance of even precipitation is deteriorated due to increased viscosity of the plating bath. Also, with the plating bath of the present embodiment, it is more desirable to set the concentration of the chelating agent to 0.002 to 1 mol/L, since precipitation of nickel hydroxide or decomposition of the plating bath then may be suppressed more effectively.

A variety of known additives contained in the electroless nickel plating solution may be added as necessary to the plating bath of the present embodiment. Examples of these additives may be enumerated by reaction accelerators, brighteners, surface active agents.

In the plating bath of the present embodiment, preferably an iron ion source and an iodide ion source are contained as a stabilizer for the plating bath beforehand, and an oxidizing agent is added during the plating operation, as set out above.

Conventionally, an oxidizing agent was used by itself as a stabilizer. However, since the oxidizing agent is reduced by a reducing agent in a plating bath, the useful life of the oxidizing agent becomes shorter, such that it may become difficult to preserve the plating bath in stability. On the other hand, if the oxidizing agent is used by itself as a stabilizer for the plating bath, it is necessary to vary the amount of replenishment of the oxidizing agent during the time other than the time of a plating operation from that during the time of the plating operation. It is thus difficult to stabilize the plating bath.

With the plating bath of the present embodiment, the iron ion source and the iodide ion source are contained in the bath, and a necessary amount of the oxidizing agent is added to the bath during the plating operation. Thus, with the plating bath of the present embodiment, it is possible to reduce the quantity of active hydrogen generated by the oxidation of the reducing agent to suppress the plating bath from being decomposed to stabilize the bath.

More specifically, with the plating bath of the present embodiment, the temperature of the plating bath may be increased to preserve the bath in a stabilized state under the action shown by the formulas (1) to (3), in case of not performing the processing for plating. Moreover, with the plating bath of the present embodiment, the oxidizing agent of the fixed quantity may be replenished at the time of the processing for plating, thereby stabilizing the plating bath. Thus, in comparison with the case of using the oxidizing agent by itself, the plating bath may be preserved with ease in a more stable state.

In addition, with the plating bath of the present embodiment, the plating bath may be stabilized by the cyclic reactions indicated by the formulas (1) to (3). Hence, the amount of addition of the oxidizing agent at the time of the processing for plating may be diminished. In this manner, film characteristics, such as the rate of precipitation of the nickel plating film, in a state when the bath has been used for long, may be caused to change only slightly from those at the time of initial make-up of the bath, thereby providing optimum film characteristics. The state at the time of initial make-up of the bath means such a state in which the processing for plating is carried out with the use of a newly formed plating bath. On the other hand, the state when the bath has been used for long means such a state in which, with the use of the hypophosphite as a reducing agent, the concentration of phosphorous acid, an oxide of the hypophosphorous acid in the plating bath, or sulfuric acid, derived from nickel sulfate, for example, has increased. If the iodate ion source is used as the oxidizing agent, the amount of iodine accumulated in the plating bath may be reduced as a result of reduction of the iodic acid, thereby decreasing the amount of iodine accumulated in the plating bath. It is thus possible to decrease changes in characteristics, such as the rate of precipitation of the plating film, resistance to corrosion of the plating film or the performance of even precipitation of the plating film.

<Method for Managing the Plating Bath>

Next, the method for managing the plating bath during the time other than the time of the plating operation and during the time of the plating operation, according to the present embodiment, will now be described. The above mentioned oxidizing reaction of the reducing agent (precipitation of the plating film or decomposition of the plating bath), appreciably depends on the temperature of the plating solution. While differing with the compositions, for example, of plating baths, the temperature of a plating bath during the time other than the time of the plating operation and that during the time of the plating operation are preferably set within a range of 80 to 90° C. With this temperature range, it is possible to prevent evaporation of the plating bath from becoming vigorous to maintain the composition of the plating bath in a predetermined range as well as to prevent the plating bath from being decomposed to stabilize the plating bath.

On the other hand, if the temperature of the plating bath is raised, the amount of dissolved oxygen in the plating solution decreases to render it difficult to stabilize the plating bath. It is therefore desirable that an amount of oxygen necessary to stabilize the plating bath is caused to remain dissolved in the plating bath during the time other than the time of the plating operation and during the time of the plating operation. Such necessary amount of oxygen may be caused to remain dissolved in the plating solution by carrying out the operation in atmosphere or by stirring air at a heating section.

During the time other than the time of the plating operation, at least the iron ion source and the iodide ion source are added to the plating bath, whereby the iron ions ($Fe^{2+}$) from the iron ion source shown in the formula (1) are oxidized by oxygen dissolved in the plating solution. The cyclic reactions of the formulas (1) to (3) then proceed to decrease the amount of active hydrogen in the plating bath such as to prevent the plating bath from being decomposed to stabilize the plating bath.

On the other hand, during the time of the processing for plating, a hydrogen gas is generated as a side reaction of the processing for plating. Hence, the amount of oxygen dissolved in the plating bath becomes lower than that during the time other than the time of the plating operation. Consequently, the amount of active hydrogen is greater than that during the time other than the time of the plating operation, so that it becomes difficult to stabilize the plating bath. Thus, during the time of the processing for plating, a necessary amount of the iodate ion source or the bromate ion source is added to the plating bath containing at least the iron ion source and the iodide ion source. By so doing, the amount of active hydrogen may be diminished to stabilize the plating bath to enable continuous use of the plating bath.

<Method for Processing for Plating>

The method for plating that uses the plating bath according to the present embodiment will now be described. With the plating method of the present embodiment, an object for plating is immersed in an electroless nickel plating bath containing at least the iron ion source and the iodide ion source, such as to deposit an electroless nickel plating film on the object surface.

There is no particular limitation to the type of the object for plating by the processing for plating. That is, an object that may be plated by ordinary electroless nickel plating may be the object for plating. For example, an iron-based object, such as an object formed of iron or an iron alloy, or an aluminum-based object, such as an object formed of aluminum or an aluminum alloy, may be used as the object for plating.

It is noted that, if an iron-based object for plating is to be plated in the plating bath of the present embodiment, it is probable that iron ions from the object for plating are dissolved into a plating bath to act on the object for plating. Hence, if the processing for plating is performed on iron products or products obtained on zincating an aluminum object, it is unnecessary to add the above mentioned iron ion source to the initially made plating bath.

The method for pre-processing the object for plating will now be described. For example, if the object for plating is formed of iron, processing by a cleaner and processing by chromating, well-known per se, are applied by way of pre-processing. If the object for plating is formed of an aluminum alloy, processing by a cleaner and processing by zincating are applied. The processing by zincating is the processing by substitution by zinc. On the other hand, if the object for plating is formed of an aluminum alloy material, it is processed by zincating, in accordance with a method disclosed in Japanese laid-open Patent Publication 5-230664, and then by electroless nickel plating.

The pH of the plating solution will now be described. The pH of the plating bath is preferably on the order of 4.4 to 7.0. With this range of pH, the reducing reaction by a reducing agent is allowed to occur efficiently to prevent decomposition of the reducing agent as well as to prevent the performance of precipitation for plating from being deteriorated and to prevent the plating bath from being decomposed. Moreover, with this range of pH, it is possible to prevent the plating bath from being lowered in stability as a result of the excessively high reducing potential of the reducing agent. As pH adjustment agents, used to adjust the pH to the above range, inorganic acids, such as sulfuric acid or phosphoric acid, sodium hydroxide, or ammonia water, may be used.

The temperature of the plating solution for carrying out the processing for plating will now be described. Although the temperature of the plating solution used for processing for plating differs with the compositions of the plating bath, for example, it is preferably on the order of 70 to 95° C. With this temperature range, it is possible to prevent that the reaction of precipitation for plating becomes sluggish to cause failure in precipitation of the nickel plating film or poor film appearance. In particular, with the plating bath according to an embodiment of the present invention, the temperature of the plating solution at the time of the processing by plating is set to 80 to 90° C., thereby more effectively preventing non-precipitation of the nickel plating film or poor film appearance.

The rate of precipitation of the nickel plating film will now be described. If the temperature of the plating bath is 90° C., for example, the rate of precipitation of the nickel plating film is preferably 2 to 20 μm/hr. With this rate of precipitation, it is possible to prevent workability from being lowered or to prevent the plating bath from becoming destabilized. In case the temperature of the plating bath is 90° C., the rate of precipitation of the nickel plating film is preferably 4 to 16 μm/hr. With this rate of precipitation, the plating bath may be prevented more effectively from becoming destabilized.

With the plating method of the present embodiment, in which an object for plating is plated by a plating bath containing at least an iron ion source and an iodide ion source, the plating bath may be prevented from being decomposed, thereby stabilizing the bath and providing for optimum characteristics of the plating film. In addition, with the plating method of the present embodiment, in which an iodate ion source or a bromate ion source is further contained in the plating bath, the plating bath may be prevented from being decomposed to stabilize the bath. By so doing, the film characteristics of the plating film may be optimized even in case of continuously using the plating bath.

EXAMPLE

A specified Example of the present invention will now be described. It should be noted that the present invention is not to be limited to the following Example.

(Sample 1)

For a sample 1, an electroless nickel plating solution of the following bath composition is a basic bath. 1 mg/L of iron sulfate, shown in Table 1 below, was added to the basic bath, and adjustment was made so that the bath volume will be equal to 2 L. An iron plate (printer shaft 10 mm in diameter and 300 mm in length), an object for plating, pre-processed by cleaner processing and by chromating, was plated at 1 $dm^2/L$, for 60 minutes, in the plating bath kept at 90° C., with the rate of precipitation of the nickel plating film of 14 μm/hr.

(Bath Composition)

| | |
|---|---|
| nickel sulfate | 25 g/L |
| malic acid | 10 g/L |
| lactic acid | 15 g/L |
| succinic acid | 10 g/L |
| sodium hypophosphite | 25 g/L |
| pH | 4.6 (adjusted with ammonia) |

(Sample 2)

For a sample 2, processing was carried out in the same way as with the sample 1, except that 500 mg/L of potassium iodide was added in place of iron sulphate and that potassium iodate was added at a rate of 10 mg/L at intervals of 15 minutes as from the time of the start of the processing for plating.

(Sample 3)

For a sample 3, processing was carried out in the same way as with the sample 1, except that iron sulphate was not added and that potassium iodate was added at a rate of 10 mg/L at intervals of 15 minutes as from the time of start of the processing for plating.

(Sample 4)

For a sample 4, processing was carried out in the same way as with the sample 1, except that iron sulphate was not added and that 500 mg/L of potassium iodide was added.

(Sample 5)

For a sample 5, processing was carried out in the same way as with the sample 1, except that 500 mg/L of potassium iodide was added along with iron sulphate.

(Sample 6)

For a sample 6, processing was carried out in the same way as with the sample 1, except that 500 mg/L of potassium iodide was added along with iron sulphate and that potassium iodate was added at a rate of 10 mg/L at intervals of 15 minutes as from the time of start of the processing for plating.

(Reference Example)

For a reference sample, processing was carried out in the same way as with the sample 1, except that 0.5 mg/L of lead acetate was added in place of iron sulphate.

The samples 1 to 6 and the reference sample are summarized in Table 1 below.

Then, evaluation was made of stability of the plating bath and characteristics of the plating film.

<Evaluation of Stability of Plating Bath>

As regards the stability of the plating bath, it was evaluated by visually observing the state of the plating solution, based on the following criterion points:

○: no nickel precipitation occurred at a heating section where the temperature was highest; no impalpable powder of nickel were generated throughout the entire plating solution.

Δ: nickel precipitation occurred at the heating section.

x: impalpable powders of nickel were generated throughout the entire plating solution; the plating bath was decomposed.

The results shown in Table indicate the following: the plating bath of the sample 5, containing iron sulphate and potassium iodide, the plating bath was sufficient in stability in 30 minutes after the start of the processing for plating, however, the plating bath was decomposed in 60 minutes as from the start of the processing for plating. With the plating bath of the sample 6, containing iron sulphate and potassium iodide, and to which was periodically added potassium iodate after start of the processing for plating, the plating bath was sufficient in stability after 30 minutes and after 60 minutes as from the start of the processing for plating.

Thus, with the plating baths of the samples 5 and 6, iron sulphate and potassium iodide were contained in the plating baths to decrease the amount of active hydrogen to prevent the plating baths from being decomposed to stabilize the plating bath. With the plating bath of the sample 6, potassium iodate was further added after start of the processing for plating. This may decrease the amount of active hydrogen to prevent decomposition of the plating bath to provide a stabilized plating bath that can be used continuously. Viz., with the plating baths of the samples 5 and 6, decomposition of the plating baths could be suppressed without using harmful metal species as with the Reference Example. There may thus be provided a plating bath whose stability is equivalent to that of a bath that uses the harmful metal species.

With the plating baths of the samples 1 and 4 that use either iron sulphate or potassium iodide by itself, the amount of active hydrogen could not be decreased. The plating baths were decomposed and were not sufficient in stability. With the plating bath of the sample 2, containing potassium iodide and added periodically by potassium iodate after start of the processing for plating, nickel was precipitated at the heating

TABLE 1

| stabilizer species | Reference Example | Sample 1 | Sample 2 | Sample 3 | Sample 4 | Sample 5 | Sample 6 |
|---|---|---|---|---|---|---|---|
| lead ion (added as lead acetate) (mg/L) | 0.5 | — | — | — | — | — | — |
| iron ion (added as iron sulfate) (mg/L) | — | 1 | — | — | — | 1 | 1 |
| iodide ion (as KI)(mg/L) | — | — | 500 | — | 500 | 500 | 500 |
| iodate ion (as $KIO_3$) added at intervals of 15 minutes (mg/L) | — | — | 10 | 10 | — | — | 10 |
| rate of precipitation (μm/hr) | 14 | 14 | 14 | 14 | 14 | 14 | 14 |
| stability after plating for 30 minutes at 1 $dm^2/L$ | ○ | X | Δ | Δ | X | ○ | ○ |
| stability after plating for 60 minutes at 1 $dm^2/L$ | X | X | Δ | Δ | X | X | ○ |

section, with the plating bath not being sufficient in stability. With the plating bath of the sample 3, only added by potassium iodate, the plating bath may tend to be stabilized, however, nickel precipitation occurs at the heating section, with the plating bath not being sufficient in stability.

From the results of evaluation on the stability of the plating bath, as set out above, it is seen that the iron ion source and the iodide ion source contained in the plating bath play an important role in decreasing the amount of active hydrogen to prevent the plating bath from being decomposed to stabilize the plating bath. In addition, it is seen that addition of a compound that generates the iodate ion source, after start of the processing for plating, in addition to the inclusion of the iron ion source and the iodide ion source, is also critical in decreasing the amount of active hydrogen to prevent the plating bath from being decomposed to stabilize the bath.

<Evaluation of Characteristics of Nickel Plating Film>

In connection with the evaluation of characteristics of the nickel plating film, the following two points were checked. First, it was visually checked whether or not nickel was evenly precipitated at an edge part of a test piece (steel plate) as well. Second, it was checked by a ferroxyl test whether or not just smaller numbers of pits were formed in the nickel plating film. The ferroxyl test, conducted to evaluate rust stability, is such a test in which a filter paper sheet, immersed in a test solution, is bonded to a surface being tested to check blue speck that might appear on the filter paper sheet in register with the active points of corrosion. As the test solution, a mixed aqueous solution of potassium ferrocyanide, potassium ferricyanide and sodium chloride, was used.

With the plating baths of the samples 5 and 6, containing iron sulfate and potassium iodide, nickel could be uniformly precipitated even at edge parts of a plated test piece. It was also made certain that the nickel plating film obtained with the use of the plating baths of the samples 5 and 6 suffered from only smaller numbers of pits. It is seen from these results that the nickel plating films, obtained with the use of the plating baths of the samples 5 and 6, exhibit sufficient film characteristics.

It is also seen that the nickel plating films, obtained with the use of the plating baths of the samples 5 and 6, exhibit sufficient film characteristics equivalent to those of the plating nickel films obtained with the plating bath of the Reference Example that makes use of harmful metal species.

Conversely, the plating baths of samples 1 to 4, devoid of iron sulphate and potassium iodide, were decomposed, as mentioned previously, with the characteristics of the resulting nickel plating film not being sufficient.

It is seen from the above results that the use of the plating baths of the samples 5 and 6, containing the iron ion source and the iodide ion source, may lead to a stabilized plating bath, with the characteristics of the resulting nickel plating film being sufficient.

It should be understood by those skilled in the art that various modifications, combinations, sub-combinations and alterations may occur depending on design requirements and other factors insofar as they are within the scope of the appended claims or the equivalents thereof.

What is claimed is:

1. An electroless nickel plating bath comprising:

an iodate ion source or a bromate ion source as an oxidizing agent, wherein said iodate ion source is at least one out of potassium iodate, sodium iodate and ammonium iodate, and wherein said bromate ion source is at least one out of potassium bromate, sodium bromate and ammonium bromate;

an iron ion source; and an iodide ion source.

2. The electroless nickel plating according to claim 1, wherein said iodate ion source is at least one out of potassium iodate and sodium iodate, and wherein said bromate ion source is at least one out of potassium bromate and sodium bromate.

3. The electroless nickel plating bath according to claim 1, wherein said iron ion source is at least one out of iron sulfate, iron chloride, iron sulfide, iron nitrate and iron oxide.

4. The electroless nickel plating bath according to claim 1, wherein said iodide ion source is at least one out of potassium iodide, iron iodide, nickel iodide, lithium iodide and sodium iodide.

5. The electroless nickel plating bath according to claim 1, the electroless nickel plating bath further comprising:

a water-soluble nickel salt;

a reducing agent; and a complexing agent.

6. A stabilizer for an electroless nickel plating bath comprising:

an iodate ion source or a bromate ion source as an oxidizing agent, wherein said iodate ion source is at least one out of potassium iodate, sodium iodate and ammonium iodate, and wherein said bromate ion source is at least one out of potassium bromate, sodium bromate and ammonium bromate;

an iron ion source; and an iodide ion source.

7. An electroless nickel plating bath for depositing an electroless nickel plating film on a surface of an iron-based object, the electroless nickel plating bath comprising;

an iodide ion source; and an iodate ion source or a bromate ion source as an oxidizing agent, wherein said iodate ion source is at least one out of potassium iodate, sodium iodate and ammonium iodate, and wherein said bromate ion source is at least one out of potassium bromate, sodium bromate and ammonium bromate.

* * * * *